US009390637B2

(12) United States Patent
Varveris

(10) Patent No.: US 9,390,637 B2
(45) Date of Patent: Jul. 12, 2016

(54) THIN-WALL PANEL MODULAR LIGHT BOX SIGN AND DISPLAY

(71) Applicant: Nicholas G Varveris, Palo Alto, CA (US)

(72) Inventor: Nicholas G Varveris, Palo Alto, CA (US)

( * ) Notice: Subject to any disclaimer, the term of this patent is extended or adjusted under 35 U.S.C. 154(b) by 0 days.

(21) Appl. No.: 13/936,115

(22) Filed: Jul. 5, 2013

(65) Prior Publication Data

US 2014/0007474 A1 Jan. 9, 2014

Related U.S. Application Data

(60) Provisional application No. 61/669,636, filed on Jul. 9, 2012.

(51) Int. Cl.

| | |
|---|---|
| ***G09F 13/04*** | (2006.01) |
| ***G09F 13/18*** | (2006.01) |
| ***G09F 13/22*** | (2006.01) |
| ***A47G 1/06*** | (2006.01) |

(52) U.S. Cl.

CPC ..... *G09F 13/0413* (2013.01); *A47G 1/0616* (2013.01); *G09F 13/18* (2013.01); *G09F 13/22* (2013.01); *G09F 2013/1831* (2013.01); *G09F 2013/1836* (2013.01); *G09F 2013/1881* (2013.01); *G09F 2013/222* (2013.01)

(58) Field of Classification Search

CPC ..... F21S 8/035; F21S 10/00; F21V 9/00; F21V 9/08; F21V 7/04; F21V 19/00; G09F 7/22; G09F 13/00; G09F 13/04; G02F 1/133604; G02F 1/133608; G02F 1/133606; G02F 1/133603; G02F 1/133605

USPC ..... 40/541, 564; 362/97.1–97.4, 362, 367

See application file for complete search history.

(56) References Cited

U.S. PATENT DOCUMENTS

| | | | | |
|---|---|---|---|---|
| 3,938,270 | A | 2/1976 | Santini | |
| 4,384,279 | A | 5/1983 | Fujita | |
| 4,602,448 | A | 7/1986 | Grove | |
| 4,805,324 | A * | 2/1989 | Andersson | 40/541 |
| 5,347,735 | A * | 9/1994 | Pratt | 40/518 |
| 5,379,540 | A | 1/1995 | Howard | |
| 5,584,566 | A | 12/1996 | Bowman et al. | |
| 6,150,949 | A | 11/2000 | Eschbach et al. | |
| 7,549,245 | B2 | 6/2009 | Ter-Hovhannissian | |
| 7,748,148 | B2 | 7/2010 | Reiland et al. | |
| 7,823,308 | B1 | 11/2010 | Munson et al. | |
| 8,267,564 | B2 | 9/2012 | Kim et al. | |
| 2006/0227574 | A1 * | 10/2006 | Chien | 362/641 |

(Continued)

FOREIGN PATENT DOCUMENTS

| | | | |
|---|---|---|---|
| CN | 201897934 U | * | 7/2011 |
| EP | 0150534 A2 | | 8/1985 |
| RU | 2178588 C1 | * | 1/2002 |

OTHER PUBLICATIONS

IFIT Light Panel Brochure (http://www.ledconn.com/documents/2013_Catalog_v001.pdf), 2013, 20 pages, Brea, CA, US.

(Continued)

*Primary Examiner* — Cassandra Davis

(74) *Attorney, Agent, or Firm* — Paradice and Li, LLP

(57) ABSTRACT

A thin wall modular display (TWMD) useful for signs, lighting fixtures etc. is disclosed wherein a back-lit sign, light fixture or TWMD is created using a plastic multi-chambered thin-walled panel and light strips.

11 Claims, 5 Drawing Sheets

(56) References Cited

U.S. PATENT DOCUMENTS

2007/0236413 A1* 10/2007 Gehlsen et al. ..... 345/48
2008/0037287 A1* 2/2008 Krohn ..... 362/632

OTHER PUBLICATIONS

Makrolon LD T by Bayer Material Science LLC Brochure, © Copyright, Bayer, Jun. 2012, 2 Pages, Sheffield, MA, US.

* cited by examiner

THIN-WALL PANEL MODULAR LIGHT BOX SIGN AND DISPLAY

CROSS-REFERENCES TO RELATED APPLICATIONS

This application claims priority to U.S. Provisional Application Ser. No. 61/669,636 filed Jul. 9, 2012 the contents of which are incorporated herein by reference.

BACKGROUND OF THE INVENTION

The present invention relates to inexpensive bright energy efficient illuminated signs, lighting fixtures and displays. It relates particularly to signs used to advertise real estate for sale or rent, but advantages of the present invention would be applicable to various other signs, displays and light devices for a variety of other uses.

Prior art signs are generally wood, plastic or metal panels with text and indicia printed on both sides and suspended by a cross arm attached to a post, or attached to a rectangular or U shaped frame. In particular most real estate signs used today are not illuminated and as a result cannot be easily seen at night. This is particularly unfortunate during winter months when people who are potential home buyers are commuting home from work at dusk or night during winter or daylight savings times. At such times an illuminated sign may catch their attention where otherwise the home for sale may go unnoticed.

There are a few existing solutions that try to address this problem, but they have failed to gain widespread use. Generally real estate signs are placed near the front of the property or street where there is no readily available source of electric power. To solve this problem several kinds of signs and signage lighting systems use battery power charged by a solar panel. Currently such signs are commonly lit by shining a light at them (from the top, bottom or sides), or back lit (where a light source is placed in a box behind a translucent panel). Examples of these signage solutions fall into two groups. Group one are signage lighting systems that light standard real estate signs by shining a light at them. Examples of this group are disclosed in Holman, U.S. Pat. No. 7,585,085 B1, the contents of which are incorporated herein by reference. Meyers, et al., U.S. Pat. No. 7,357,527, the contents of which are all incorporated herein by reference. Giannone, U.S. Pat. No. 6,004,002, the contents of which are incorporated herein by reference and Doyle, U.S. Pat. No. 5,101,329 the contents of which are incorporated herein by reference. The other group includes various forms of back-lit signage powered by solar charged batteries. Examples of these include: Reading, U.S. Pat. No. 5,729,924, Emert, U.S. Pat. No. 6,263,601 B1, the contents of which are incorporated herein by reference, and Ter-Hovhannissian, U.S. Pat. No. 7,549,245 B2 the contents of which are incorporated herein by reference.

It is believed the reason these signs have not gained wide spread acceptance and use is the often unorthodox and unprofessional appearance of the signs, as well as, the cost associated with their complex designs. In addition, these and other prior art back lit signs or displays are bulky requiring a custom built box-like enclosure; or, if made with an edge lit panels, are heavy and are limited in size. Also, prior art signs using light emitting diode (LED) light strips tend to exhibit "hot spots", which are sections where the light is more intense than other sections, i.e. uneven light distribution. The instant invention provides solutions to these problems.

SUMMARY OF THE INVENTION

This invention relates to the design of a novel thin, bright, energy efficient, inexpensive illuminated thin-wall panel modular display (TWMD) suitable for signs and other uses. A TWMD is disclosed comprising a thin wall panel comprising two outer walls with a plurality of ribs in between such that a series of chambers are created in the thin wall panel. The TWMD comprises at least one light strip. The light strip may be positioned on an edge of the TWMD or within one or more chambers of the thin wall panel or both. In one embodiment the TWMD may be powered by a battery, preferably a solar charged battery, or connected to an AC or DC power source. The TWMD is particularly well suited to be used as an illuminated replacement for the current form of real estate signs without a significant change to the outward appearance of the sign during daylight hours. The design may be adapted for vehicle signage, house number signs, emergency exit signs, and a variety of other illuminated display or lighting uses.

A solar powered real estate sign has been selected to illustrate the invention by way of example and is hereinafter described in detail with reference to accompanying drawings.

DETAILED DESCRIPTION OF THE INVENTION

Figure 1:
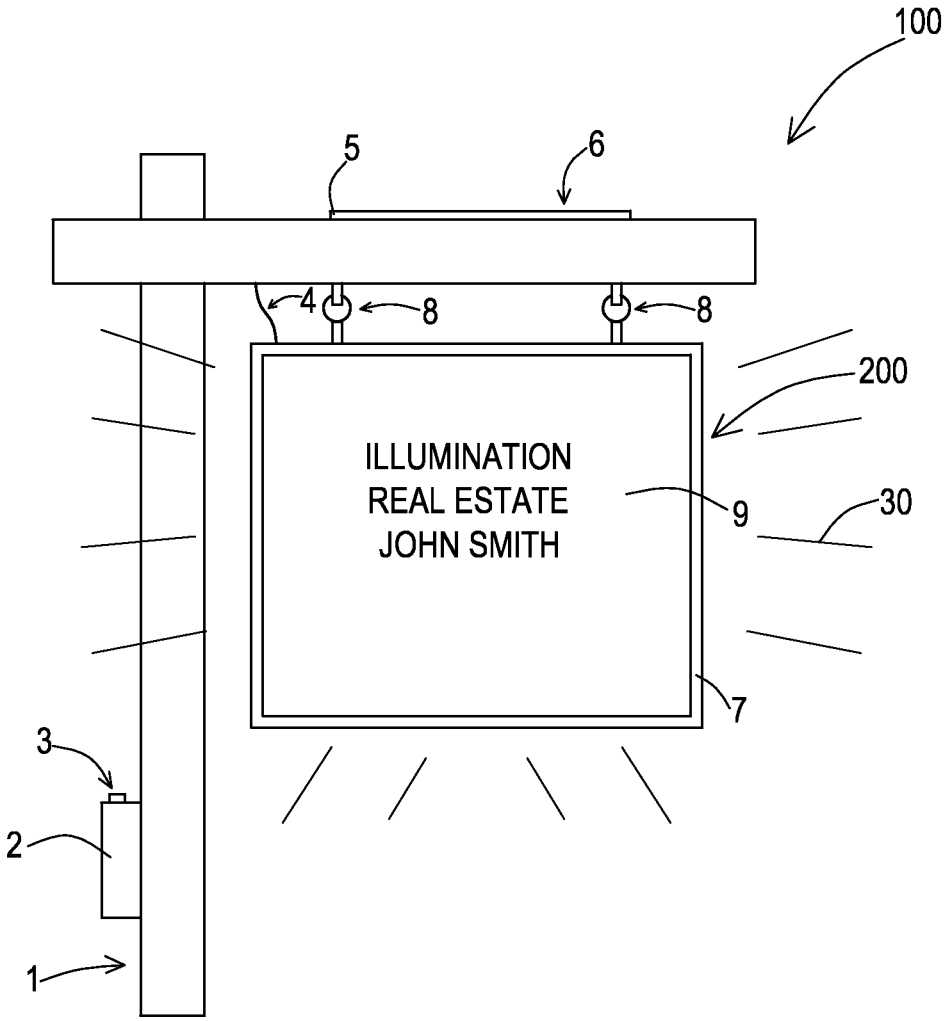
FIG. 1 shows a night view of a thin-wall panel modular display (TWMD) illuminated for use as a real estate sign according to one embodiment of the invention.

Reference will now be made in detail to some specific embodiments of the invention including the best modes contemplated by the inventor for carrying out the invention. Examples of these specific embodiments are illustrated in the accompanying figures. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs. It is understood that the embodiments described herein including the figures disclose only illustrative but not exhaustive examples of the present invention. It should be apparent to those skilled in the art that many different ways of powering, controlling, lighting, shaping, and attaching or displaying lighted displays and fixtures incorporating the invention are possible without departing from the spirit and scope of the invention. All patents, publications and disclosures disclosed herein are hereby incorporated herein by reference in their entirety for all purposes.

In one embodiment the present invention is a thin, bright, energy efficient, inexpensive back-lit illuminated TWMD suitable for signs and other display uses. In one embodiment the TWMD may be assembled from only a few parts and at the same time comprises an easily changeable number of light sources. Another advantage of the TWMD is that it is thin, preferably less than three quarters of an inch thick so it is suitable as a replacement for traditional real estate signage, and traditional picture frames and may also be used for other forms of signage, lighting, advertising or art displays. Other advantages of the invention are its light weight and strength, and it can be easily fabricated with simple hand or power tools.

The present invention alters the structure and composition of prior art thin wall panels to create an effective and pleasing TWMD having many different uses. The thin wall panels used in the present invention can comprise any material but preferred are thermoplastics and particularly preferred are polycarbonate (PC), PC-acrylonitrile-butadiene-styrene (ABS) mixtures; ABS; polyacrylates, for example poly(methylmethacrylate) (PMMA); acrylonitrile styrene acrylate (ASA) styrene-acrylonitrile (SAN); polyalkylenes, e.g., polypropylene (PP); and polyesters, e.g., poly(butanolterephthalate) (PBT).

In one embodiment the invention contemplates thin wall panels comprising outer walls having ribs attached thereto. By "attached" it is meant joined or fastened. The thin wall panels comprise at least one light strip positioned on or within the thin wall panel. By "positioned" it is meant placed physically in a location. As used herein "location" includes any part of the TWMD including the perimeter edges, the outer or inner walls and chambers. When used herein "light strip" is meant to include structures comprising at least one light means. A preferred light means or light is a light emitting diode (LED) but the invention contemplates that many types of light means are suitable including electroluminescent ceramics, electroluminescent wire, organic light emitting diode (OLED), neon, xenon and halogen lights, depending on the desired end use. The light strip may comprise a single light means or a plurality of light means. The lights on the light strip may be arranged in any order or shape desired. The light strip also comprises a means for connecting or interconnecting several light strips to an electrical power source. The light strip may be flat, round or other shape and may be flexible or rigid. The light strip may comprise any width and length. The light strip used in the present invention may comprise a laminate structure comprising two or more layers. Suitable laminates for the light strip include films covering or partially covering the light strip having a surface relief pattern to enhance contrast or focus or disperse light. In another embodiment a binary phase grating may be used in the laminate structure for a larger viewing angle or a blazed phase grating for a narrower viewing angle. Binary phase gratings are known in the art for example in U.S. Pat. No. 6,906,861 B2 the contents of which are incorporated herein by reference in its entirety. A blazed grating also called an echelette grating is a type of diffraction grating optimized to achieve maximum grating efficiency in a given diffraction order. Maximum optical power is concentrated in the desired diffraction order while the residual power in the other orders (particularly the zeroth) is minimized. The direction in which maximum efficiency is achieved is called the blaze angle and is the third crucial characteristic of a blazed grating directly depending on blaze wavelength and diffraction order. Particularly useful is a light diffusion layer for reducing hot spots. Light diffusion sheets and compositions are known in the art and their use is contemplated with this invention. In one embodiment the invention contemplates that Makrolon LD™ by Bayer Material Science LLC which is a polycarbonate sheet may be placed over an outer surface of the TWMD or the light box frame. In one embodiment a polycarbonate diffuser layer is laminated to the light strip. In another embodiment the thin wall panel may comprise a thermoplastic comprising a filler that will scatter and diffuse light. For example, a mineral filler particle like vitriolic barium having a mesh size of 300 and constituting an approximate 5% wt. of the thermoplastic can be added. Barium sulfate is a white pigment powder that can be used as filler in plastics and may act as a diffuser for a light source. The particle size is approximately 50 microns. One embodiment of the invention contemplates that the walls of the thin wall panel will be composed of a thermoplastic with a light diffusing additive while the ribs of the panel will be composed without the additive.

In one embodiment the outer walls may comprise films which comprise at least one layer of material. Preferably a thermoplastic and preferably the walls have the shape of a flat sheet. However, each wall or rib may be independently the same or different and may have a different three-dimensional structure which is not identical to the structure of the other outer wall or internal ribs.

In one embodiment of the invention the inside of one or both of the outer walls may be structured such that the wall is not smooth but has ridges or a repeating zig zag pattern. Similar examples of structured surfaces are described in the art in EP Patent Application 0150534 A2, the contents of which are incorporated herein by reference in its entirety.

With reference to FIG. 1 there is shown a frontal view of a preferred embodiment of a thin-wall panel modular light box display sign unit (TWMD Unit) 100 powered by a solar charged battery (not shown). Preferably the TWMD Unit 100 includes a sign post 1 and a battery (not shown) enclosed in a battery enclosure 2. Light 30 radiates from the front of the TWMD 200. The invention contemplates that the TWMD Unit 100 may also include a transformer, a charge controller and/or a timer or programmable control switch. The TWMD Unit 100 comprises a TWMD 200 which comprises a light box frame 7; attachment means 8, power cord 4 and a front display surface 9. The front display surface 9 may comprise a transparent, a substantially transparent or a translucent film and may have printed thereon text and/or indicia. The battery enclosure 2 may be mounted externally on the sign post 1, but alternatively it may be mounted within the sign post structure 1 or within the light box frame 7. The battery powering the TWMD 200 is controlled by a photo cell switch 3 and is connected to and charged by a solar panel 6. Power cord 4 connects the light strips within the TWMD 200 to the battery via the switch 3. Solar panel 6 may be attached to the sign post 1 and may be encased in a waterproof enclosure or frame 5. In another embodiment the solar panel may be attached directly to the light box frame 7 of the display 200. The TWMD 200 may be mounted or attached to sign post 1 via attachment means 8. The TWMD 200 may be controlled by an on/off switch, a programmable timer, photo cell, remotely controlled switch or even a dimmer switch mechanism or a combination thereof. The TWMD 200 may be AC, DC, battery or solar powered or a combination thereof.

Figure 2:
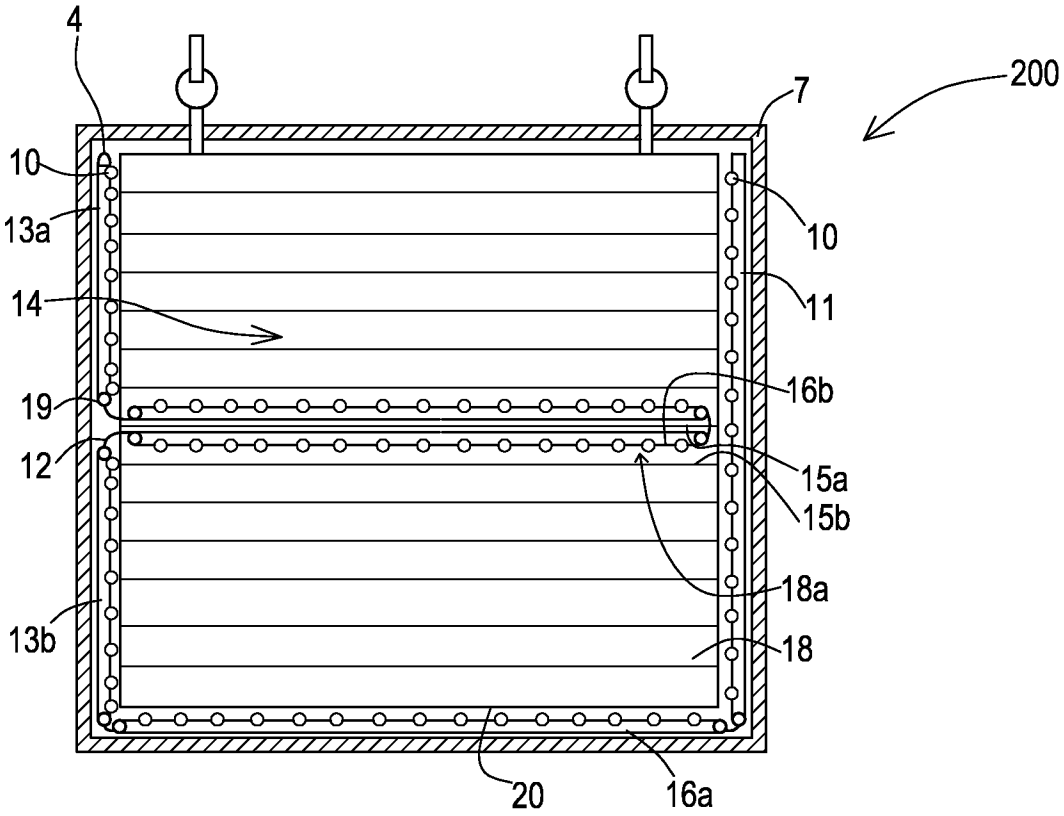
FIG. 2 shows a cross section front view of a TWMD used as a real estate sign according to one embodiment of the invention.

FIG. 2 shows a cross section front view of the TWMD 200 described in FIG. 1. The TWMD 200 comprises a light box frame 7 which encloses or partially encloses a translucent or transparent extruded plastic multi-chambered thin-wall panel 14. The light box frame 7 may be assembled using mechanical means such as screws and joining plates. In one embodiment the light box frame 7 can be designed to snap together, or assembled using other means. Light box frame 7 encloses thin-wall panel 14. The invention contemplates a variety of TWMD shapes. There exists a variety of means possible for sealing or framing the thin-wall panel 14. The frame may also be entirely omitted in some embodiments. The light box frame 7 may comprise metal c channel framing and may comprise a material chosen from the group consisting of wood, plastic, rubber, ceramic framing, durable tape and caulking material. Thin wall panel 14 comprises ribs 15*a* and 15*b* framing chamber 18*a*. In a preferred embodiment chambers 18 and 18*a* extend across the width of the thin wall panel 14.

Thin wall panels suitable for some embodiments of the invention include multiple wall sheets such as Verolite™ Multiwall Sheet manufactured by AmeriLux™ International, LLC. There are different wall structures that are suitable for some embodiments of the present invention. Modular light emitting diode (LED) light strips 11, 13*a*, 13*b*, 16*a*, 16*b* provide illumination. Light strip 16*b* is positioned in a chamber 18*a* defined by ribs 15*a*, 15*b*. The light strips may comprise different lengths. Light strips 11, 13*a*, 13*b*, 16*a*, 16*b* may comprise different colors and/or shapes. Light strips 11, 13*a*, 13*b*, 16*a*, 16*b* may be interconnected one to the other electrically so that one power source powers the TWMD 200 via power cord 4. In one embodiment the light strips are connected in series using a snap together connector 12 with a detachable end 19. Light strips 11, 13*a*, 13*b*, 16*a*, 16*b* may comprise a rigid material or a flexible material that will bend around various curved panel shapes or between the ribs. Light strips 11, 13*a*, 13*b*, 16*a*, 16*b* may be of any width desired provided they are sufficiently narrow that they can be inserted in thin wall panel chambers 18, 18*a* or placed around the perimeter of the thin wall panel 14. In one embodiment the modular light strips 11, 13*a*, 13*b*, 16*a*, 16*b* comprise a plurality of LEDs 10 such that one, two, four or any number of LEDs 10 in light strip 11, 13*a*, 13*b*, 16*a*, 16*b* emit light in an arc away or substantially away from the top of the plane defined by the length and width of the light strip 11, 13*a*, 13*b*, 16*a*, 16*b*. In another embodiment, the light strips 11, 13*a*, 13*b*, 16*a*, 16*b* comprise a plurality of LEDs 10 that may emit light alternating from the top and bottom of the light strips 11, 13*a*, 13*b*, 16*a*, 16*b*. In another embodiment, the light strips 11, 13*a*, 13*b*, 16*a*, 16*b* comprise a plurality of LEDs 10 that can be individually controlled to emit various intensities and/or colors of light. LED 10 within a light strip 11 may be recessed within the light strip 11 so that the top surface of the LED 10 is flush with the top surface of the light strip 11 or the LED 10 may protrude from the top of the light strip 11. In one embodiment the chambers 18, 18*b* comprise light strips but not the perimeter of the thin wall panel 14. The flexibility of varying positioning of light strips 11, 13*a*, 13*b*, 16*a*, 16*b* without requiring any special vestibule or attachment means to hold or connect the light strips is an advantage over the prior art. TWMD 200 may also comprise a light diffusing sheet. This sheet may be positioned over the TWMD 200 outer walls to diffuse light from the light strips 11, 13*a*, 13*b*, 16*a*, 16*b*.

In one embodiment light strips 13*a* and/or 13*b* are positioned along the perimeter edge of the TWMD 200 such that the center of at least one LED and preferably all LEDs in the light strip are substantially aligned with the center of a chamber such that a straight line through the center of a chamber the line would intersect the center of an LED on a light strip.

Figure 3:
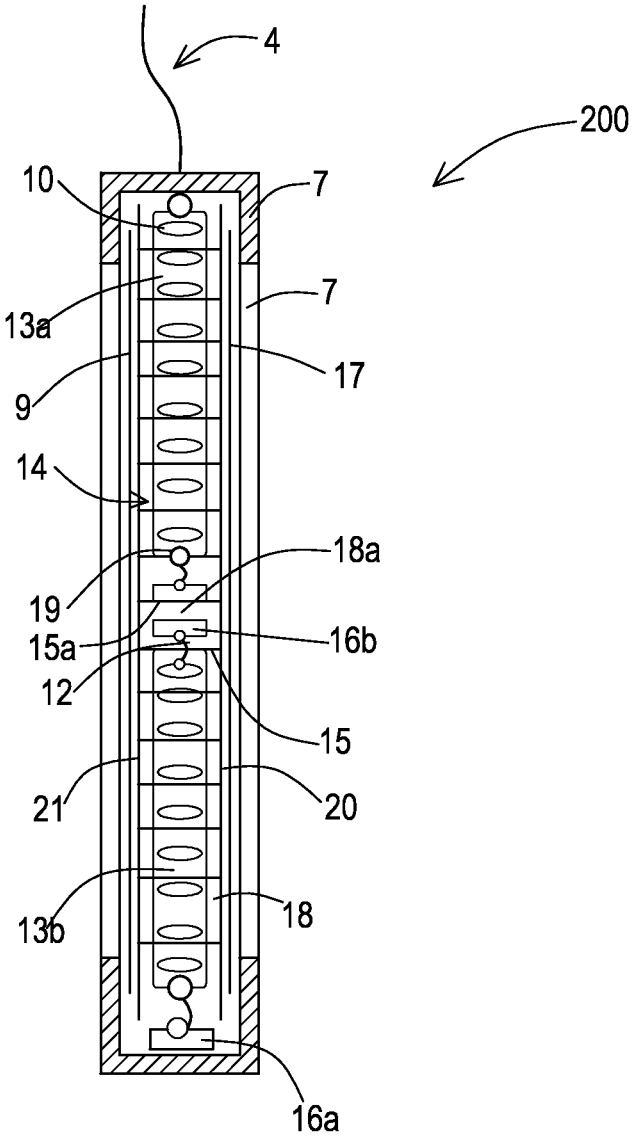
FIG. 3 shows a cross section side view of a TWMD used as a real estate sign viewed from a right side according to one embodiment of the invention.

FIG. 3 shows a cross section side view of the TWMD 200 shown in FIGS. 1 and 2. First outer wall 20 comprises an inner and outer surface wherein the inner surface faces inwardly towards the inside of light box frame 7 and the outer surface is on the opposite side of the inner surface facing outwardly from the light box frame 7. Light box frame 7 encases thin wall panel 14 which comprises first outer wall 20 and second outer wall 21. Positioned between first outer wall 20 and second outer wall 21 are ribs 15*a*, 15 (corresponds to 15*b*, FIG. 2). The space between ribs 15 and 15*a* is a chamber 18*a* in which light strip 16*b* is positioned. Any thickness is suitable for the first and second outer wall 20, 21 and the thickness may be the same or different but preferably is 0.05 to 2 mm, and more preferably 0.2 to 1.0 mm. For TWMDs 200 with a large frontal surface area the thickness may be 3 mm or thicker.

The thin wall panel 14 may be made by any method such as extrusion processes known in the art. One such method is disclosed in U.S. Patent Publication No. 2002/0170662 A1 published Nov. 21, 2002 the contents of which are incorporated herein by reference in their entirety. 3D printing is also a method for making the thin wall panels of the present invention. A display surface of the first outer wall 20 of the thin wall panel 14 may have laminated thereon or placed in close proximity thereto a sheet 17 which may comprise a translucent or transparent film and may comprise indicia and/or text printed thereon. TWMD 200 may also comprise sheet 9 which may comprise a translucent or transparent film comprising indicia and/or text printed thereon. In one embodiment a diffusing sheet or film is positioned over the front and/or back wall of the TWMD 200 and/or light box frame 7. For example, the outer walls 20, 21 of the TWMD 200 may be coated or laminated with a light diffusing film. First and second sheets 17, 9 may be independently the same or different and can comprise a reflective film or mirrored surface to reflect light that would otherwise pass out through the outer wall 20, 21. In this manner the light may be reflected back toward the front or rear of the sign or display increasing the front TWMD 200 brightness. Sheet 9 and/or 17 may be blank or omitted. Sheet 9 and/or 17 may comprise a reflective film or surface so that the TWMD 200 may be used as a light fixture. In one embodiment the TWMD 200 comprises surface printing on a surface of the first and/or second outer wall 20, 21. The invention contemplates that one or more light strips 16*a* may be positioned along a side edge on one or more edges of the TWMD 200 using any attachment means desirable such as adhesives, tape, mechanical fasteners, Velcro, magnets and the like. FIG. 3 shows light strip 16*a* which may extend horizontally along all or a portion of the bottom edge of TWMD 200. Light strip 16*b* is positioned between rib 15 and 15*b* and extends horizontally along chamber 18*a*. Light strips 13*a*, 13*b* extend vertically along the side edge of TWMD 200. Detachable end 19 may connect light strips. The invention contemplates that the ribs may have a hole or plurality of holes therein and light strips may be positioned in the holes thus crossing multiple ribs.

Figure 4:
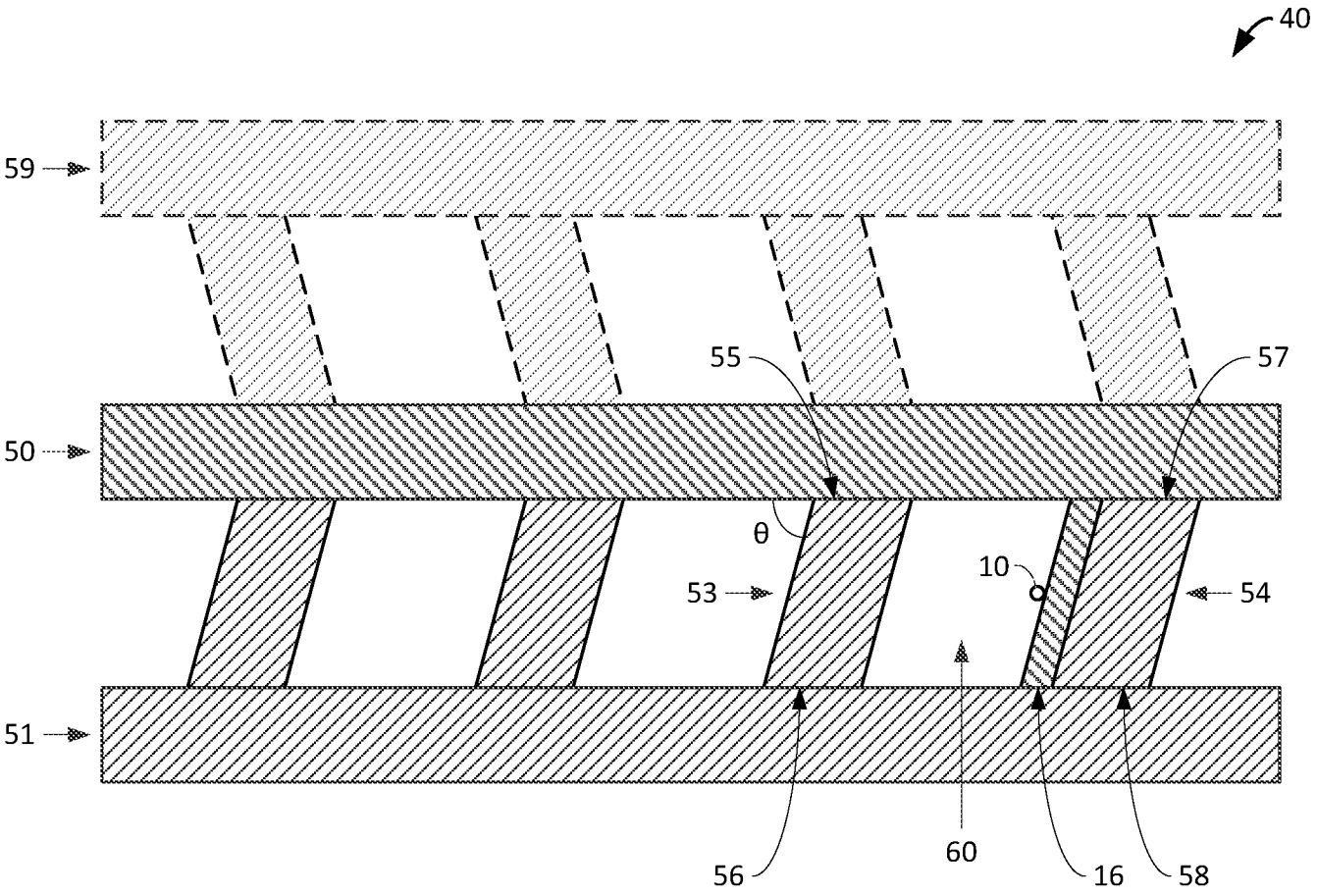
FIG. 4 shows a cross section side view of a thin wall panel used in a TWMD according to one embodiment of the invention with a light strip and connecting ribs.

FIG. 4 shows a cross section side view of a thin wall panel 40 used in a TWMD in accordance with one embodiment of the invention. Thin wall panel 40 comprises a first outer wall 50 and second outer wall 51 and are connected by first rib 53 having a first edge 55 and a second edge 56 and second rib 54 having a first edge 57 and a second edge 58. The first edge 55 is on an opposite end of said first rib 53 from said second edge 56. The first edge 55 of said first rib 53 is attached to said first outer wall 50 and said second edge 56 of said first rib 53 is attached to said second outer wall 51. The first rib 53 and second rib 54 and a section of the first outer wall 50 and a section of the second outer wall 51 define a chamber 60. Positioned inside chamber 60 is light strip 16 containing LED 10. Adjacent chambers may also include light strips (not shown for simplicity) similar to light strip 16. The first rib 53 has a first edge 55 that may be attached to or connect to the first outer wall 50 at any angle θ. The angle theta θ may be 90 degrees, 60 degrees, or may be between 15 degrees to 135 degrees, for example. The second rib 54 has a first edge 57 that may join the first outer wall 50 at any angle. The angle may be 90 degrees, 60 degrees, or may be between 15 degrees to 135 degrees, for example. The first rib 53 has a second edge 56 that may join the second outer wall 51 at any angle. The angle may be 90 degrees or 60 degrees, or may be between 15 degrees to 135 degrees, for example. The second rib 54 has a second edge 58 that may join the second outer wall 51 at any angle. The angle may be 90 degrees or 60 degrees, or may be between 15 degrees to 135 degrees, for example. The invention contemplates structures where the first and second ribs join the first and second outer walls, which comprise ribs that are bent. The invention contemplates that the first rib 53 and/or the second rib 54 may be the same or different. Ribs 53, 54 may be different lengths. Ribs 53, 54 may comprise different materials and shapes. Thin wall panels 40 according to the instant invention may comprise additional walls in addition to first outer wall 50 and second outer wall 51. For example, some implementations may include a third wall 59 attached by ribs to the first outer wall 50 (or second outer wall 51). The third wall 59 may be spaced apart and substantially parallel to the first outer wall 50 and second outer wall 51. This three wall structure may be configured in any order, including, for example, third wall 59/first outer wall 50/second outer wall 51 or first outer wall 50/third wall 59/second outer wall 51. The rib structures and/or positioning of ribs connecting the third wall to the first outer wall 50 may be the same or different than the rib structures connecting first outer wall 50 and second outer wall 51. These differences in walls and rib structures provide a means for spreading or channeling light within the TWMD in order to provide the desired illumination. In one embodiment of the invention one or more walls and/or ribs of the laminate structure may be substantially optically transparent, translucent or opaque. The invention contemplates that outer walls 50 and 51 may have printing on one or the other or both.

Figure 5:
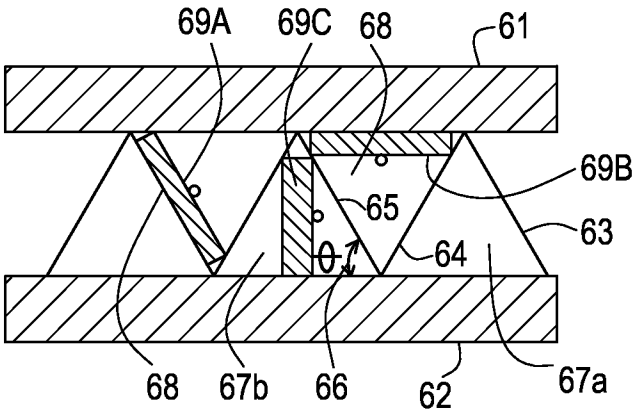
FIG. 5 shows a cross section view of a thin wall panel used in a TWMD where the chamber is substantially shaped like an equilateral triangle.

FIG. 5 shows another embodiment of the present invention. The invention contemplates that a chamber within the thin wall panel is not limited to being defined by two walls and two ribs. Structures are contemplated where the chamber may be defined by only two walls or three walls or other numerical combinations of walls and ribs. Outer walls 61 and 62 are connected by ribs 63, 64, 65. Light strip 69*a* is positioned on rib 68 and extends horizontally along the thin wall panel. Light strip 69*b* is positioned between rib 64 and 65 and held in place by the sloping walls of rib 64 and 65 and extends horizontally along the thin wall panel. Light strip 69*c* is centered in chamber 67*b* and held in place by adjacent ribs due to friction. Rib 65 joins the second outer wall 62 at angle theta 66 which is 60 degrees and the ribs in conjunction with either the first outer wall 61 or the second outer wall 62 from an equilateral triangle. In other embodiments the angle theta 66 may be 90 degrees, 60 degrees, or may be between 15 degrees to 135 degrees for example. One advantage of having thin wall panels where the ribs have different angles allows for the placement of light strips and optic layers such as diffraction, diffusion and refraction films on the ribs to interact with the light sources for a variety of end results.

In one embodiment of the present invention flexible photovoltaic strips may be placed in the chambers 67*a* and/or 67*b* in conjunction with or in place of the light strips. The angle theta 66 may be optimized to provide a maximum source of light impinging on the photovoltaic cell. In some embodiment ribs may have holes placed therein for the cooling of cells and/or light strips.

The invention contemplates that TWMDs according to the present invention may be useful as light source placements, power sources, shapes, signage, lighting or displays such as emergency exit signs, traffic signs that would be more identifiable from opposing sides of traffic, business signage, including portable trade show signage, photograph and art framing and display, new or retrofitting lighting fixtures for outdated incandescent and fluorescent light fixtures are non limiting examples.

In claim 1 I claim a thin wall modular display (TWMD) comprising:

a thin wall panel, at least one light strip, wherein the thin wall panel comprises a first outer wall and a second outer wall spaced apart from the first outer wall, and further comprising, a first rib and a second rib positioned between said first and second outer walls, wherein each of said first and second ribs has a first edge and a second edge, wherein the first and second edges are on opposite ends of said first rib and said second rib, wherein said first edge of said first rib is attached to said first outer wall and said second edge of said first rib is attached to said second outer wall, and said first edge of said second rib is attached to said first outer wall and said second edge of said second rib is attached to said second outer wall, wherein:

a chamber is created.

In claim 2 I claim a thin wall modular display (TWMD) as claimed in claim 1, wherein:

at least one light strip is positioned within a chamber.

In claim 3 I claim a thin wall modular display (TWMD) as claimed in claim 1, wherein:

at least one light strip is positioned on an edge of the thin wall panel.

In claim 4 I claim a thin wall modular display (TWMD) as claimed in claim 1, further comprising, a third wall, wherein:

said third wall is attached to either of said first outer wall or said second outer wall by a plurality of ribs.

In claim 5 I claim a thin wall modular display (TWMD) as claimed in claim 1, wherein: the light strip comprises at least one light chosen from the group consisting of LEDs, OLEDs, electroluminescent ceramics, electroluminescent wire, neon, xenon and halogen lights.

In claim 6 I claim a thin wall modular display (TWMD) as claimed in claim 1, further comprising:

a solar panel, a photovoltaic cell and a photovoltaic unit.

In claim 7 I claim a thin wall modular display (TWMD) as claimed in claim 1, which is used as a sign, a lighting display, a photograph display, an art framing display or a lighting fixture.

In claim 8 I claim a thin wall modular display (TWMD) as claimed in claim 1, further comprising:

printed matter on either the first outer wall, the second outer wall or both.

In claim 9 I claim a thin wall modular display (TWMD) as claimed in claim 8, wherein: at least one light strip is positioned within a chamber.

In claim 10 I claim a thin wall modular display (TWMD) as claimed in claim 8, wherein:

at least one light strip is positioned on an edge of the thin wall panel.

In claim 11 I claim a thin wall modular display (TWMD) as claimed in claim 8, further comprising, a third wall, wherein:

said third wall is attached to either of said first outer wall or said second outer wall by a plurality of ribs.

In claim 12 I claim a thin wall modular display (TWMD) as claimed in claim 8, wherein: the light strip comprises at least one light chosen from the group consisting of LEDs, OLEDs, electroluminescent ceramics, electroluminescent wire, neon, xenon and halogen lights.

In claim 13 I claim a thin wall modular display (TWMD) as claimed in claim 8, further comprising:

a solar panel, a photovoltaic cell, a photovoltaic unit.

In claim 14 I claim a thin wall modular display (TWMD) as claimed in claim 8, which is used as a sign, a lighting display, a photograph display, an art framing display or a lighting fixture.

In claim 15 I claim a sign comprising:

a thin wall transparent panel, wherein:

the thin wall panel comprises a first outer wall and a second outer wall spaced apart from the first outer wall, and further comprising:

a first rib and a second rib positioned between said first and second outer walls, wherein each of said first and second ribs has a first edge and a second edge, wherein the first and second edges are on opposite ends of said first rib and said second rib, wherein said first edge of said first rib is attached to said first outer wall and said second edge of said first rib is attached to said second outer wall, and said first edge of said second rib is attached to said first outer wall and said second edge of said second rib is attached to said second outer wall, wherein a chamber is created, and further comprising:

printed matter on either the first outer wall, the second outer wall or both.

In claim 16 I claim a kit for assembling a TWMD, comprising:

a thin wall panel, at least one light strip, wherein the thin wall panel comprises a first outer wall and a second outer wall spaced apart from the first outer wall, and further comprising, a first rib and a second rib positioned between said first and second outer walls, wherein each of said first and second ribs has a first edge and a second edge, wherein the first and second edges are on opposite ends of said first rib and said second rib, wherein said first edge of said first rib is attached to said first outer wall and said second edge of said first rib is attached to said second outer wall, and said first edge of said second rib is attached to said first outer wall and said second edge of said second rib is attached to said second outer wall, wherein:

a chamber is created.

In claim 17 I claim a kit for assembling a TWMD as claimed in claim 16, wherein: the light strip comprises at least one light chosen from the group consisting of LEDs, OLEDs, electroluminescent ceramics, electroluminescent wire, neon, xenon and halogen lights.

In claim 18 I claim a kit for assembling a TWMD as claimed in claim 17, further comprising:

a solar panel, a photovoltaic cell, a photovoltaic unit.

What is claimed is:

1. A thin wall modular display comprising:

a thin wall panel including: a first outer wall, a second outer wall spaced apart from the first outer wall, a third wall attached between the first outer wall and the second outer wall, a first plurality of ribs positioned between the first outer wall and the third wall to create a first chamber, and a second plurality of ribs positioned between the third wall and the second outer wall to create a second chamber; a light strip to illuminate at least one of the first chamber or the second chamber, wherein the light strip is positioned on an edge of the thin wall panel; and a diffusing component to diffuse light emitted through each of the first and second outer walls.

2. The thin wall modular display of claim 1, further comprising:

at least one additional light strip positioned within at least one of the first chamber or the second chamber.

3. The thin wall modular display of claim 1, wherein:

the light strip comprises at least one light chosen from the group consisting of LEDs, OLEDs, electroluminescent ceramics, electroluminescent wire, neon and halogen lights.

4. The thin wall modular display of claim 1, further comprising: at least one of a solar panel, a photovoltaic cell or a photovoltaic unit.

5. The thin wall modular display of claim 1, further comprising:

printed matter provided on or attached to at least one of the first outer wall or the second outer.

6. A display assembly comprising:

a thin wall panel including:

a first outer wall, a second outer wall spaced apart from the first outer wall, and a plurality of ribs positioned between the first and second outer walls to create a plurality of chambers, wherein each chamber is bounded by the first outer wall, the second outer wall, and two of the plurality of ribs; and at least one light strip positioned on an edge of the thin wall panel and comprising a plurality of discrete light sources, wherein each light source of the plurality of discrete light sources is aligned with a center of a respective one of the plurality of chambers to illuminate that chamber.

7. The display assembly of claim 6, wherein the at least one light strip is coupled to at least one of a solar panel, a photovoltaic cell, or a photovoltaic unit.

8. The display assembly of claim 7, wherein the at least one light strip comprises an electroluminescent (EL) wire.

9. The display assembly of claim 6, further comprising:

at least one additional light strip positioned within the plurality of chambers.

10. The display assembly of claim 6, wherein the plurality of discrete light sources includes at least one of a light emitting diode (LED), an organic light emitting diode (OLED), a neon light, a xenon light, or a halogen light.

11. The display assembly of claim 6, further comprising:

printed matter provided on at least one of the first outer wall or the second outer wall.

* * * * *